US010026277B2

(12) United States Patent
Huo

(10) Patent No.: US 10,026,277 B2
(45) Date of Patent: Jul. 17, 2018

(54) EVACUATION GUIDANCE DEVICE FOR RESCUE

(71) Applicant: 4B DREAM Co., Ltd., Gwangju (KR)

(72) Inventor: Kwan Huo, Gwangju (KR)

(73) Assignee: 4B DREAM CO., LTD., Gwangju (KR)

( * ) Notice: Subject to any disclaimer, the term of this patent is extended or adjusted under 35 U.S.C. 154(b) by 0 days.

(21) Appl. No.: 15/387,710

(22) Filed: Dec. 22, 2016

(65) Prior Publication Data

US 2017/0213431 A1 Jul. 27, 2017

(30) Foreign Application Priority Data

Jan. 25, 2016 (KR) ..... 10-2016-0008899

(51) Int. Cl.

| | |
|---|---|
| ***G08B 7/06*** | (2006.01) |
| ***B65H 75/44*** | (2006.01) |
| ***F21V 23/02*** | (2006.01) |
| ***F21V 27/00*** | (2006.01) |
| ***B65H 75/40*** | (2006.01) |
| ***G09F 19/00*** | (2006.01) |
| *F21Y 115/20* | (2016.01) |
| *F21Y 103/10* | (2016.01) |
| *H05B 33/22* | (2006.01) |

(52) U.S. Cl.

CPC ..... *G08B 7/066* (2013.01); *B65H 75/406* (2013.01); *B65H 75/4471* (2013.01); *B65H 75/4486* (2013.01); *B65H 75/4492* (2013.01); *F21V 23/02* (2013.01); *F21V 27/005* (2013.01); *G09F 19/00* (2013.01); *B65H 2701/3915* (2013.01); *F21Y 2103/10* (2016.08); *F21Y 2115/20* (2016.08); *H05B 33/22* (2013.01)

(58) Field of Classification Search

CPC ..... G08B 7/066; B65H 75/4471; B65H 75/4486; F21V 23/02; F21V 27/005

See application file for complete search history.

(56) References Cited

U.S. PATENT DOCUMENTS

2009/0058587 A1* 3/2009 Engler ..... H01F 5/04 336/192

FOREIGN PATENT DOCUMENTS

| | | | |
|---|---|---|---|
| KR | 10-2004-0090043 | A | 10/2004 |
| KR | 20-2008-0002562 | U | 7/2008 |
| KR | 10-1016940 | B | 2/2011 |
| KR | 10-2013-0102970 | A | 9/2013 |

* cited by examiner

*Primary Examiner* — Kabir A Timory

(74) *Attorney, Agent, or Firm* — Eric L. Lane; Green Patent Law

(57) ABSTRACT

The present disclosure relates to an evacuation guidance device for rescue, and more particularly, to an evacuation guidance device for rescue, which is capable of securing an evacuation route through a linear illuminator to guide an evacuee to a safety zone and bidirectionally communicating with a rescue agent to evaluate a rescue situation, when an emergency situation occurs in a building due to fire, power failure, a gas leakage, and the like. In the evacuation guidance device for rescue according to the present disclosure, a position of the bobbin unit may be identified through the first and second position notifying luminescence members so that there is an advantage in which position determination of the evacuee or the rescue agent may be easy.

13 Claims, 8 Drawing Sheets

EVACUATION GUIDANCE DEVICE FOR RESCUE

CROSS-REFERENCE TO RELATED APPLICATION

This application claims priority to and the benefit of Korean Patent Application No. 10-2016-0008899, filed on Jan. 25, 2016, the disclosure of which is incorporated herein by reference in its entirety.

BACKGROUND

1. Field of the Invention

The present disclosure relates to an evacuation guidance device for rescue, and more particularly, to an evacuation guidance device for rescue, which is capable of securing an evacuation route through a linear illuminator to guide an evacuee to a safety zone and bidirectionally communicating with a rescue agent to evaluate a rescue situation when an emergency situation occurs in a building due to fire, power failure, a gas leakage, and the like.

2. Discussion of Related Art

An emergency guidance system, which is currently installed and operated in various buildings and facilities, is mostly an emergency guide light and an emergency guide sign. An object of the emergency guidance system is to provide a main function of securing an escape route, indicating an exit, and quickly and accurately promoting escape and evacuation of people, thereby minimizing the number of casualties when an emergency situation occurs.

However, the emergency guide light or the emergency guide sign indicates an escape direction by always displaying only a certain direction with an arrow, and it has no function capable of detecting the situation at the field and changing the display content according to the field situation. That is, when an emergency door is not available for a reason such as the emergency door being closed or presence of fire occurring around the emergency door, the emergency guide light or the emergency guide sign, which is fixedly installed at a building structure, may have a problem of causing more casualties due to there being no function to guide people to another safe emergency door or to secure an escape route according to the field situation.

To address such a problem, a portable linear emergency guidance device, which is capable of displaying an escape route for an evacuee through a linear illuminator and changing the escape route according to a field situation, is disclosed in Korean Registered Patent Publication No. 10-1016940.

However, the portable linear emergency guidance device has disadvantages in that it is difficult to determine how far a distance of an escape route guided by a linear illuminator and people to be rescued are from a safety zone, and to communicate with a rescue agent dispatched to rescue people as well as a commander or a control station at a safety zone.

PRIOR ART DOCUMENT

Patent Document

1. Korean Patent Application Publication No. 10-2013-0102970, entitled "Emergency flashlight provided with illuminating guidance string."

2. Korean Utility Model Application Publication No. 20-2008-0002562, entitled "Intelligent emergency guidance line system."

SUMMARY OF THE INVENTION

To address the above described problem, an object of the present disclosure is to provide an evacuation guidance device for rescue capable of easily determining a position of a bobbin around which a linear illuminator is wound and unwound, and determining an inducing distance of the linear illuminator being unwound by enabling the linear illuminator to emit a different color light at a regular interval.

Also, another object of the present disclosure is to provide an evacuation guidance device for rescue capable of enabling a bidirectional communication between a commander at a safety zone and a rescue agent, using a luminescence state of the linear illuminator.

To attain the above described objects, an evacuation guidance device for rescue, includes a bendable linear illuminator; a bobbin unit configured to wind and unwind the linear illuminator according to a rotational direction, including first and second position notifying luminescence members installed at an outer side of the bobbin unit and configured to emit light to enable position identification, and configured to supply power to the linear illuminator and the first and second position notifying luminescence members; and a case configured to rotatably accommodate the bobbin unit to enable the linear illuminator to be wound and unwound according to a rotational direction of the bobbin unit and at which a luminescence indicator is formed to enable verification of a luminescence state of each of the first and second position notifying luminescence members.

The linear illuminator may be provided with a color filter configured to change a color of light emitted from a light source at a regular interval to enable identification of length of the linear illuminator that is unwound from the bobbin unit.

The luminescence indicator may be provided with a plurality of luminescence verifying through holes which are formed at positions corresponding to the first and second position notifying luminescence members by passing through from an outer circumferential surface of the case to an inner circumferential surface thereof and are spaced apart from one another along an extending direction of each of the first and second position notifying luminescence members.

The bobbin unit may include an illuminator winding bobbin configured to wind or unwind the linear illuminator according to a rotational direction and including one side, which is adjacent to each of the luminescence verifying through holes formed at one side of the case, on which the first position notifying luminescence member is mounted; and a power supply bobbin mounted on the other side of the illuminator winding bobbin to be rotated by corresponding to a rotational direction and a rotational angle of the illuminator winding bobbin, including the second position notifying luminescence member mounted adjacent to each of the luminescence verifying through holes formed at the other side of the case, and configured to supply power to enable the linear illuminator and the first and second position notifying luminescence members to emit light.

The case may include a first cover member to which the illuminator winding bobbin is rotatably coupled and having each of the luminescence verifying through holes formed at a position corresponding to the first position notifying luminescence member; and a second cover member coupled to the first cover member, rotatably coupled to the power supply bobbin that is coupled to the illuminator winding bobbin, and having the luminescence verifying through holes formed at a position corresponding to the second position notifying luminescence member.

The illuminator winding bobbin may include a winding unit formed to extend and enable the linear illuminator to be wound along an outer circumferential surface, configured to provide a first inner space that is open in a direction of the second cover member, and including one side rotatably coupled to the first cover member and the other side coupled to the power supply bobbin; a first flange formed to have an outer diameter greater than that of the winding unit at one end thereof adjacent to the first cover member, and including a surface facing the first cover member, at which the first position notifying luminescence member is installed; and a second flange formed to extend and have an outer diameter greater than that of the winding unit at the other end thereof.

The power supply bobbin may include an illuminator winding bobbin coupler including a winding unit accommodation part which is formed to be partially accommodated in the first inner space and includes one end fixedly coupled to the illuminator winding bobbin, and an inverter mounting part having an outer diameter larger than that of the winding unit accommodation part at the other end thereof, formed to extend in a direction of the second cover member, and including a second inner space formed inside the inverter mounting part to be open in the direction of the second cover member, thereby enabling an inverter, which is connected to the linear illuminator and the first and second position notifying luminescence member, to be mounted on the second inner space; and a second cover member coupler having one side fixedly coupled to the illuminator winding bobbin coupler and the other side rotatably coupled to the second cover member, configured to provide a power supplier supplying power to the inverter and a manipulation part connecting and disconnecting a supply of the power of the power supplier to the inverter to control the linear illuminator and the first and second position notifying luminescence members to emit light through the inverter and manipulating rotation of the illuminator winding bobbin, and including the second position notifying luminescence member installed at a surface facing the second cover member.

The second cover member may be provided with an opening formed to pass through and enable the power supplier and the manipulation part to be open, thereby facilitating user manipulation of the power supplier and the manipulation part which are mounted on the second cover member coupler.

The evacuation guidance device for rescue according to the present disclosure may further includes a communication unit configured to enable communication between the end of one side of the linear illuminator, which is unwound from the bobbin unit, and the bobbin unit.

The linear illuminator may include a central strength member formed to extend and enable a winding and unwinding according to a rotational direction of the bobbin unit; a luminescence part extending along a length direction of the central strength member and provided at an outer side thereof; and a sheath part configured to cover an outer side of each of the central strength member and the luminescence part, and the communication unit may include a communication terminal installed at the end of the one side of the linear illuminator being unwound from the bobbin unit and including a first operating button configured to generate a first electrical signal; a second operating button installed at the bobbin unit and configured to generate a second electrical signal; and a controller connected to each of the second operating button and the end of the other side of the linear illuminator, configured to control a supply of power to the bobbin unit according to an operation state of the second operating button, and configured to control power required for the luminescence state of the linear illuminator according to the first and second electrical signals through an electrical path via the luminescence part and the central strength member.

The central strength member may be preferably formed with any one of a two-fold yarn and a high carbon steel wire which are conductive and are able to increase tensile strength.

The linear illuminator may be provided with a terminal part provided at the end of the one side of the linear illuminator and configured to be detachable from the communication terminal and electrically connect thereto.

The power supply bobbin may be provided with a serial connector configured to accommodate the terminal part separated from the communication terminal and electrically connected to the terminal part.

In the evacuation guidance device for rescue according to the present disclosure, a position of the bobbin unit may be identified through the first and second position notifying luminescence members so that there is an advantage in which a position determination of the evacuee or the rescue agent is easy.

Also, the evacuation guidance device for rescue according to the present disclosure emits a different color of light at a regular interval through the color filter of the linear illuminator, and thus the evacuee or the rescue agent escapes by recognizing a distance of the escape route so that there is an advantage in which a frequency of safety accidents may be reduced.

Further, the evacuation guidance device for rescue according to the present disclosure is provided with a communication unit capable of transmitting intent using a luminescence state of a linear illuminator so that bidirectional communication between the rescue agent and the commander at the safety zone is possible.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
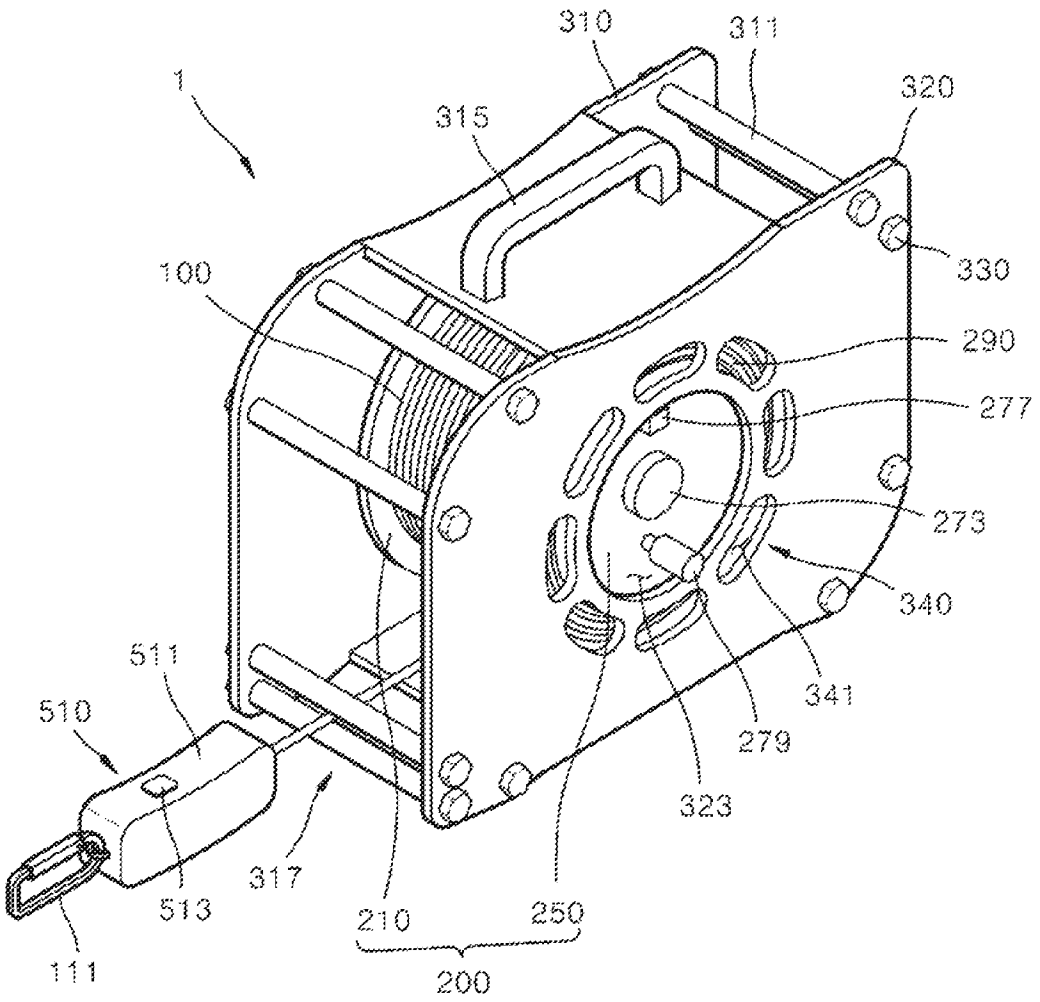
FIG. 1 is a perspective view of an evacuation guidance device for rescue according to a first embodiment of the present disclosure.

Hereinafter, an evacuation guidance device for rescue according to preferred embodiments of the present disclosure will be described in more detail with reference to the accompanying drawings.

An evacuation guidance device for rescue according to the present disclosure is used for indicating a route through which a rescue agent moves in a danger zone to rescue people in the danger zone and securing an escape route in advance when an emergency calamity such as fire or earthquake occurs.

An evacuation guidance device 1 for rescue according to a first embodiment of the present disclosure is configured with a linear illuminator 100, a bobbin unit 200, a case 300, a coupling unit 400, and a communication unit.

The linear illuminator 100 is configured with an electroluminescent (EL) wire that is bendable. A general EL wire refers to a super power-saving self-luminescence line having a continuous linear luminescence characteristic of a coaxial line structure in which an EL element, which is a luminescence semiconductor that emits light in an electric field method, is uniformly applied on a central copper wire, and an electric wire used as an electrode is provided outside of the applied EL element so that an electron is transferred according to phase change when an alternating current (AC) power is applied to the copper wire and the electric wire, and thus energy conversion occurs and light is emitted.

Figure 5:
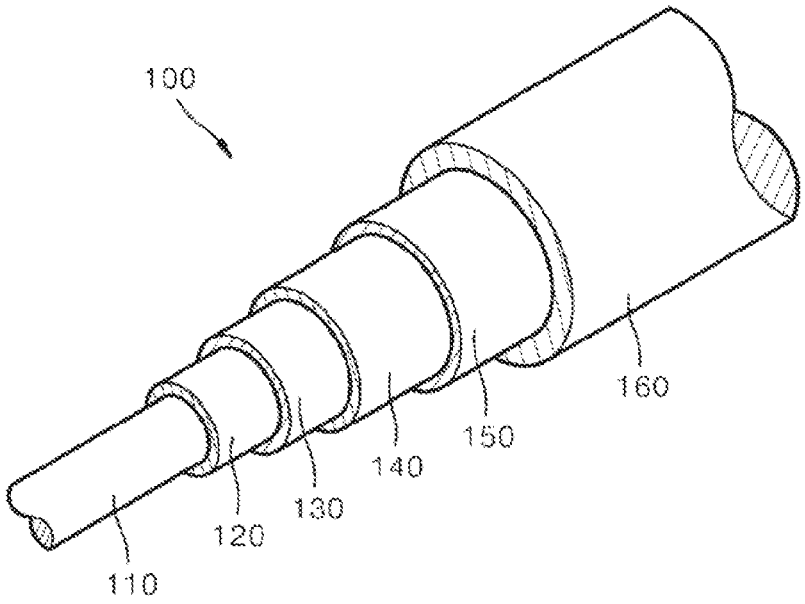
FIG. 5 is a perspective view of a partial cross-section of a linear illuminator of FIG. 1.

As shown in FIG. 5, the linear illuminator 100 may be an EL wire which is configured with a central electrode 110, a dielectric layer 120, a luminescence layer 130, a surface electrode 140, a color filter 150, and a sheath layer 160. The linear illuminator 100 has a structure in which an AC power is applied between the central electrode 110 and the surface electrode 140, electrons are transferred inside the luminescence layer 130 according to a phase change, light is emitted by collisions between the electrons and a fluorescent substance inside the luminescence layer 130 so that the luminescence layer 130 linearly emits light. The dielectric layer 120 serves to charge electrons therein according to the AC power supplied from the central electrode 110 and then discharge the charged electron to the luminescence layer 130. The color filter 150 is a part configured to convert light, which is emitted from the luminescence layer 130 serving as a light source, into a predetermined color of light. The color filter 150 may be set to one of various colors such as yellow, green, red, blue, and the like. The color filter 150 may be configured with a photopolymerization type photosensitive composition and an organic pigment realizing a color. The linear illuminator 100 is connected to an inverter 600 which will be described below.

The central electrode 110 of the linear illuminator 100 acts as a minus electrode and the surface electrode 140 thereof acts a plus electrode, and they are used in the communication by the communication unit which will be described below.

Figure 2:
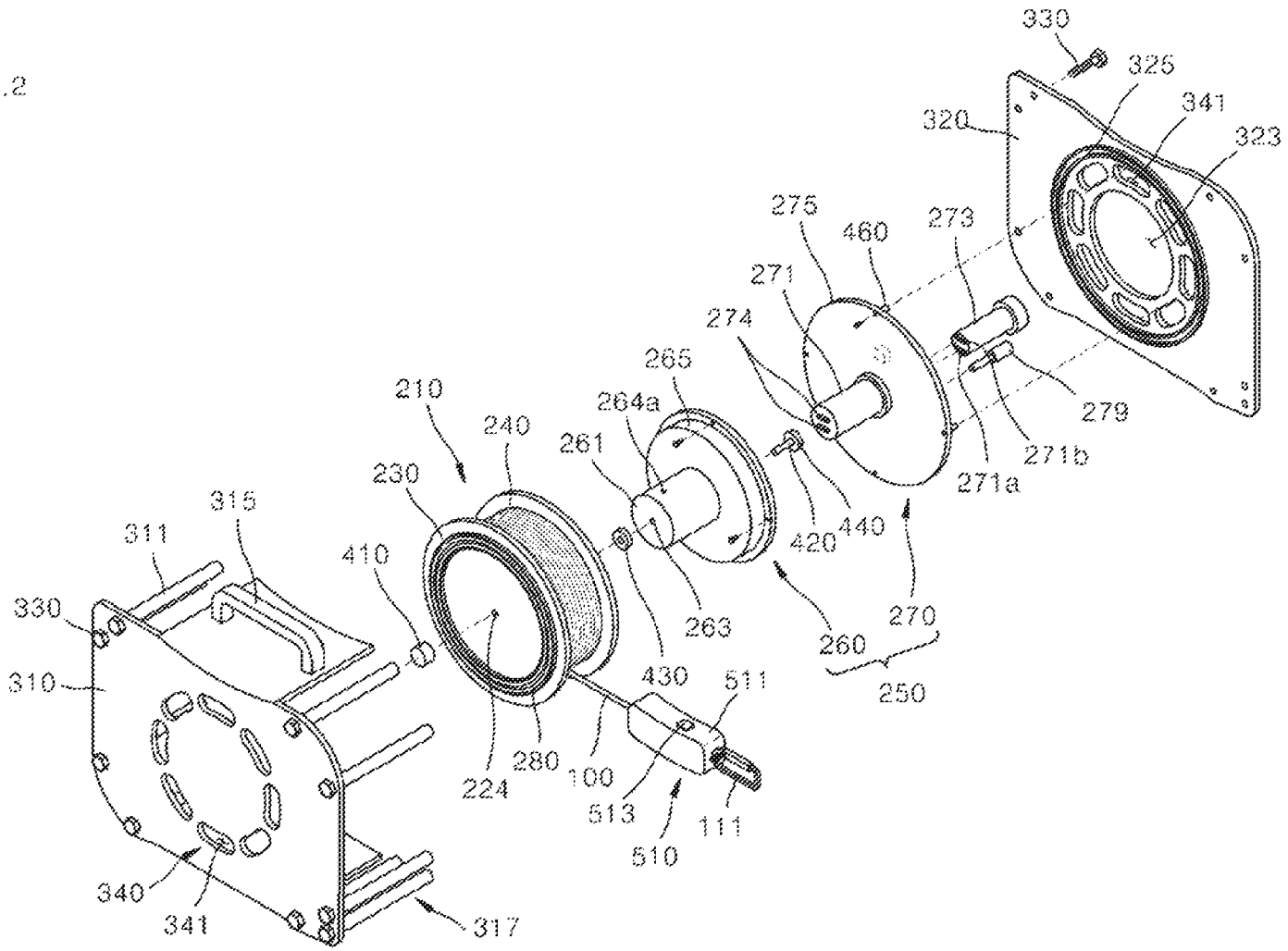
FIG. 2 is a partially exploded perspective view of the evacuation guidance device for rescue of FIG. 1.

Referring to FIGS. 1 and 2, the bobbin unit 200 is rotatably mounted inside the case 300 which will be described below. The bobbin unit 200 is a part configured to wind and unwind the linear illuminator 100 according to a rotational direction, at which first and second position notifying luminescence members 280 and 290 are installed at an outside to emit light to enable a position identification, and configured to supply power to the linear illuminator 100 and the first and second position notifying luminescence members 280 and 290.

The bobbin unit 200 is provided with an illuminator winding bobbin 210 and a power supply bobbin 250.

The illuminator winding bobbin 210 is rotatably coupled to a first cover member 310 of the case 300, which will be described below, through the coupling unit 400 to wind or unwind the linear illuminator 100 according to a rotational direction. Referring to FIG. 2, the illuminator winding bobbin 210 is configured with a winding unit 220, a first flange 230, and a second flange 240.

Figure 3:
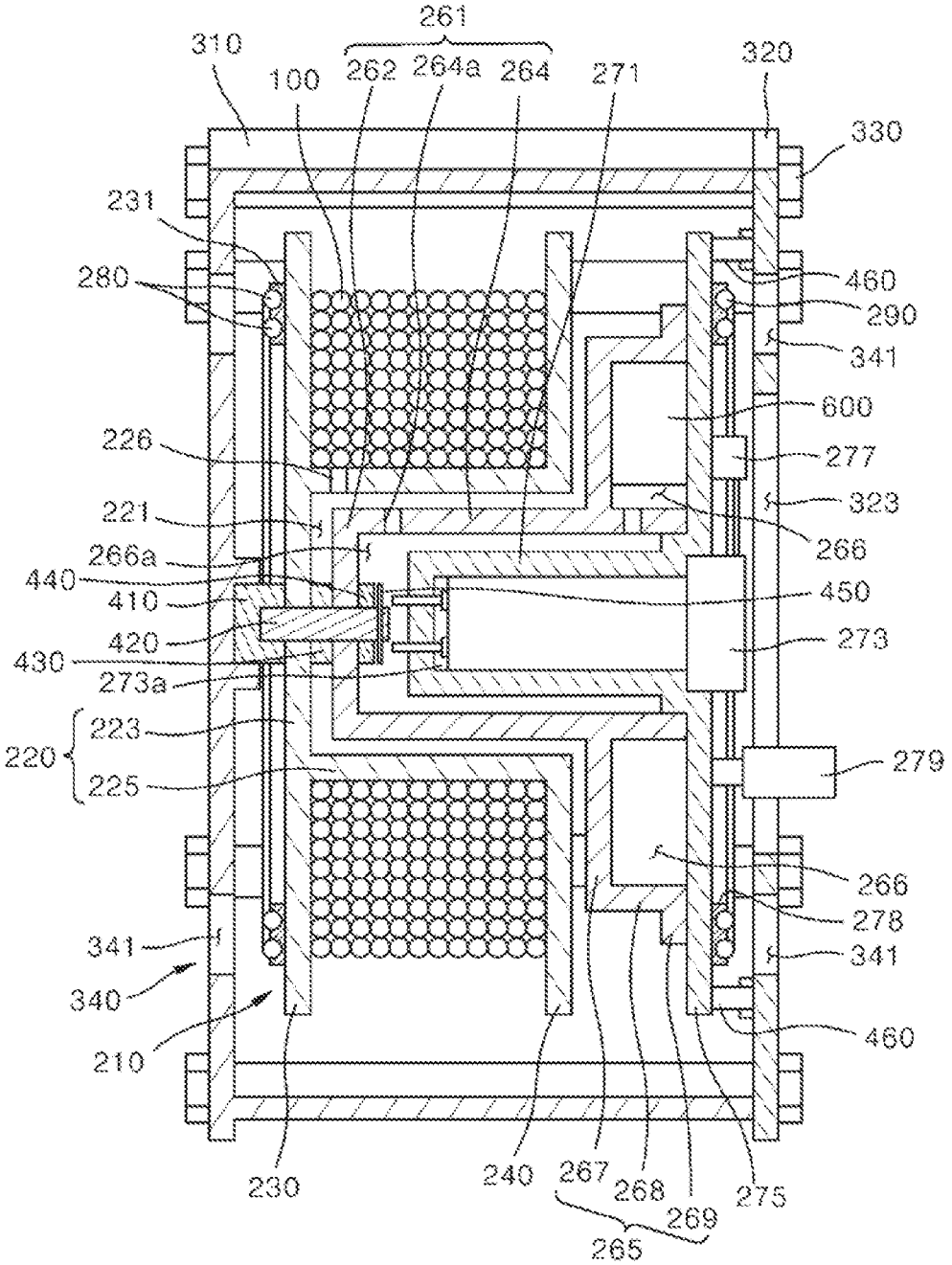
FIG. 3 is a cross-sectional view of the evacuation guidance device for rescue of FIG. 1.
Figure 4:
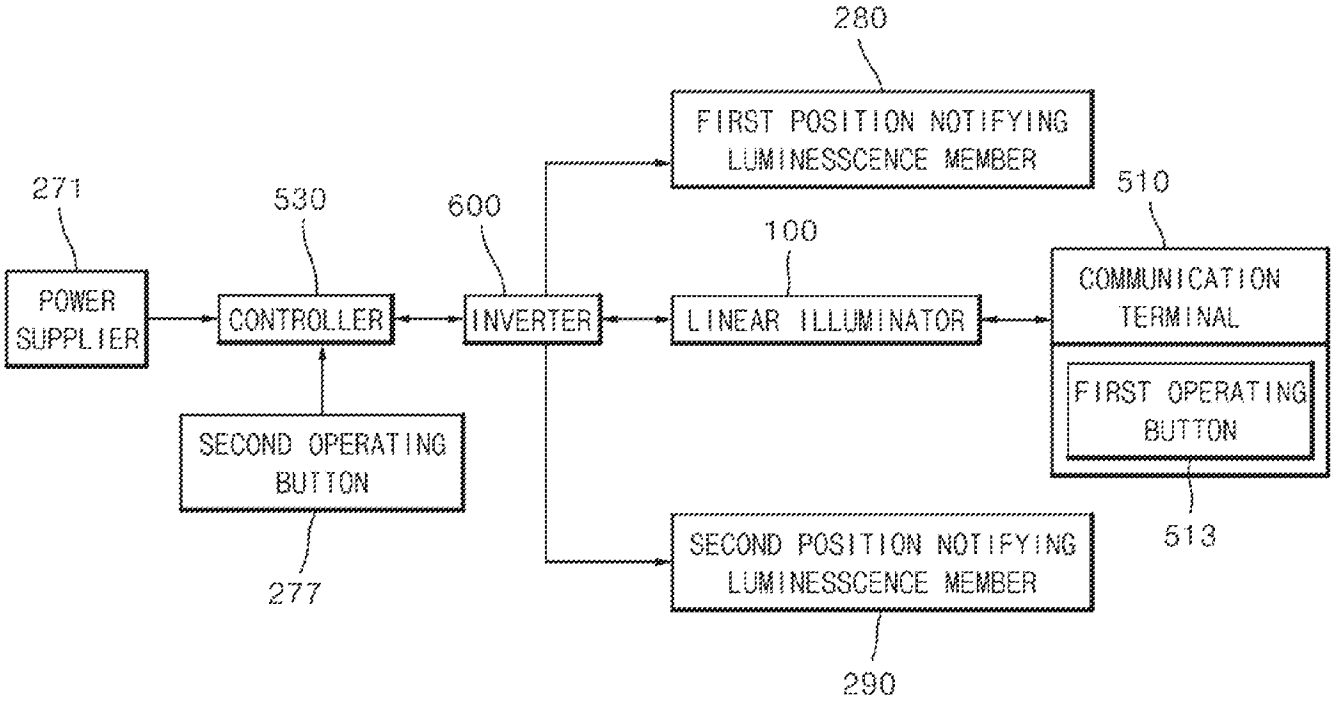
FIG. 4 is a block diagram of the evacuation guidance device for rescue of FIG. 1.

Referring to FIG. 3, the winding unit 220 is formed to extend to enable the linear illuminator 100 to be wound along an outer circumferential surface. Referring to FIG. 2, the winding unit 220 is formed to have a cylindrical shape, which is lying on its side, in which a first inner space 221, which is open in a direction of a second cover member 320 that will be described below, is provided. The winding unit 220 is provided with a first disc-shaped cover member coupler 223 rotatably coupled to the first cover member 310 that is formed at one side, and a winding main body 225 of a cylindrical shape at which the first inner space 221 is formed at an edge of the first cover member coupler 223 by extending in a direction of the second cover member 320, which will be described below, and on which the linear illuminator 100 is wound on an outer circumferential surface.

One lateral surface of the first cover member coupler 223 is rotatably coupled to the first cover member 310, and the other lateral surface thereof, which is formed in the first inner space 221, is coupled to the power supply bobbin 250. A first fixing through hole 224 is formed in a quadrangular shape at the center of the first cover member coupler 223 and passes through in a direction from the second cover member 320 to the first cover member 310. The first fixing through hole 224 is a part which is formed to pass through by corresponding to a cross-section shape of a fixing member 420 of the coupling unit 400, which will be described below, and on which the fixing member 420 passes through to be fixedly mounted. A detailed structure of each of the coupling unit 400 and the fixing member 420 will be described below. A first inverter connecting hole 226 is formed at one side of the winding main body 225 to enable the linear illuminator 100 to be connected to the inverter 600 which will be described below.

The first flange 230 is formed to have an outer diameter greater than that of the winding unit 220 at one end thereof adjacent to the first cover member 310 of the case 300, which will be described below, parallel with the first cover member 310. That is, the first flange 230 is a part which is formed to extend away from the first fixing through hole 224 along an edge of the first cover member coupler 223. A first position notifying luminescence member 280 is installed on a surface of the first flange 230 facing the first cover member 310 in a circumferential direction of the first flange 230. The EL wire applied to the linear illuminator 100 is applied to the first position notifying luminescence member 280, and the first position notifying luminescence member 280 is connected to the inverter 600 mounted on the power supply bobbin 250 which will be described below. A first luminescence member seating depression 231, on which the first position notifying luminescence member 280 is seated, is formed at the first flange 230 along a circumferential direction thereof. The first position notifying luminescence member 280 emits light to the outside and serves to facilitate position identification of each of the bobbin unit 200 and the case 300, or a user possessing the evacuation guidance device 1 for rescue.

The second flange 240 is a part which is formed to extend from the other end of the winding unit 220 in a direction parallel to the first flange 230 and thus have an outer diameter greater than that of the winding main body 225. The first flange 230 and the second flange 240 serve to support the linear illuminator 100 being wound and stacked on the winding unit 220 so that illuminator 100 does not leave from the winding unit 220 to an outward side.

Referring to FIGS. 1 and 2, one side of the power supply bobbin 250 is fixedly coupled to the other lateral surface of the first cover member coupler 223 so as to rotate corresponding to a rotational direction and a rotational angle of the illuminator winding bobbin 210, and the other side of the power supply bobbin 250 is rotatably coupled to the second cover member 320. The power supply bobbin 250 supplies power to the linear illuminator 100, the first position notifying luminescence member 280, and a second position notifying luminescence member 290, which will be described below, to enable them to emit light. The power supply bobbin 250 is configured with an illuminator winding bobbin coupler 260, a second cover member coupler 270, and the inverter 600.

The illuminator winding bobbin coupler 260 is provided with a winding unit accommodation part 261 and an inverter mounting part 265.

The winding unit accommodation part 261 is a part which is formed to be partially accommodated in the first inner space 221, and one end is fixedly coupled to the illuminator winding bobbin 210 through the fixing member 420. A third inner space 266*a* is formed to be open in a direction of the second cover member 320 inside the winding unit accommodation part 261 and communicates with a second inner space 266 of the inverter mounting part 265 which will be described below.

The winding unit accommodation part 261 is configured with a fixing member coupler 262 and an accommodation part main body 264. The fixing member coupler 262 is formed to be less than the inner diameter of the winding unit 220 and to extend in a direction parallel to the first cover member coupler 223, and a second fixing through hole 263, through which the fixing member 420 passes through to be coupled, is formed at a portion corresponding to the first fixing through hole 224. The accommodation part main body 264 is formed to extend in a direction of the second cover member 320 along an edge of the fixing member coupler 262, and the third inner space 266*a* is formed at the accommodation part main body 264. A second inverter connecting hole 264*a* is formed to pass through at one side of the accommodation part main body 264 to enable the inverter 600 to be connected to the first and second position notifying illuminator members 280 and 290 and the linear illuminator 100.

The inverter mounting part 265 is configured with a third flange 267 which is formed to extend from the other end of the winding unit accommodation part 261, that is, an end of the accommodation part main body 264 in a direction perpendicular to an outer circumferential surface of the accommodation part main body 264 and thus have an outer diameter larger than that of the accommodation part main body 264, a flange extending part 268 which is formed to extend in a direction of the second cover member 320 along an edge of the third flange 267 to provide the second inner space 266 inside the flange extending part 268, and a fourth flange 269 which is formed to extend in a direction perpendicular to an outer circumferential surface of the flange extending part 268 along an edge of the flange extending part 268 and thus have an outer diameter expanded than that of the flange extending part 268. That is, the inverter mounting part 265 is formed to have the second inner space 266 communicate with the third inner space 266*a*, and open the second inner space 266 to be open in the direction of the second cover member 320. The inverter 600 is mounted on one side of the second inner space 266 to be connected to the linear illuminator 100 and the first and second position notifying illuminator members 280 and 290.

One side of the second cover member coupler 270 is bolt coupled to the fourth flange 269 of the illuminator winding bobbin coupler 260, and the other side thereof is rotatably coupled to the second cover member 320 through a second bearing 460. The second cover member coupler 270 is provided with a power supplier 273 configured to supply power to the inverter 600 and a manipulator 276 configured to control luminescence operations of the linear illuminator 100 and the first and second position notifying illuminator members 280 and 290 through the inverter 600 by connecting and disconnecting the power supplier 273 to the inverter 600 and manipulate rotation of the illuminator winding bobbin 210.

The second cover member coupler 270 is configured with a power supplier mounting part 271 and a manipulator mounting part 275.

Referring to FIGS. 2 and 3, the power supplier mounting part 271 is formed to be partially accommodated in the third inner space 266*a*, and a battery mounting space 273*a* is formed to be open in a direction of the second cover member 320 of the case 300, which will be described below, at the power supplier mounting part 271 to enable a battery, that is, the power supplier 273 to be mounted in the battery mounting space 273*a*. The power supplier mounting part 271 is connected to power supply terminals 271*a* and 272*b* which are mounted at the end of one lateral side adjacent to the first cover member 310 of the case 300 and installed at one end of the battery and is configured with a terminal unit 274 connected to the inverter 600.

The manipulator mounting part 275 is formed to expand to be greater than the outer diameter of the power supplier mounting part 271 along an edge of the end of the other side of the power supplier mounting part 271, and a central part is formed to pass through at the manipulator mounting part 275 to open the battery mounting space 273*a*. Also, one lateral surface of the manipulator mounting part 275 is bolt coupled to the fourth flange 269, and the other lateral surface thereof is rotatably coupled to the second cover member 320 through a rotational guide member 460. The rotational guide member 460 is installed at a regular interval along a circumferential direction of the manipulator mounting part 275.

The second position notifying luminescence member 290 is installed at the other lateral surface of the manipulator mounting part 275, which faces the second cover member 320. The second position notifying luminescence member 290 is installed at a position corresponding to the first position notifying luminescence member 280 to be connected to the inverter 600, and the EL wire is applied to the second position notifying luminescence member 290 like the first position notifying luminescence member 280.

A second luminescence member seating depression 278, on which the second position notifying luminescence member 290 is seated, is formed at the other lateral surface of the manipulator mounting part 275 along a circumferential direction thereof.

The manipulator 276 mounted on the manipulator mounting part 275 is configured with a second operating button 277 connected to the power supplier 273 through a controller 530 and configured to supply power to the inverter 600 and block supplying of the power thereto, and a handle 279 configured to determine rotational movement and a rotational direction of the bobbin unit 200. The handle 279 is formed to extend in a direction from the first cover member 310 to the second cover member 320, one end of the handle 279 passes through the manipulator mounting part 275 to be coupled to the illuminator winding bobbin coupler 260, and the other end of the handle 279 is formed to protrude from the other lateral surface of the manipulator mounting part 275.

Referring to FIGS. 1 and 2, the bobbin unit 200 is rotatably accommodated inside the case 300 to enable the linear illuminator 100 to be wound or unwound according to the rotational direction of the bobbin unit 200.

The case 300 is configured with the first cover member 310, the second cover member 320, and a plurality of cover member coupling bolts 330. Also, luminescence indicators 340 are formed at the case 300 to verify a luminescence state of each of the first and second position notifying luminescence members 280 and 290.

The first cover member 310 is formed to have a plate shape, and the luminescence indicator 340 is formed at a position corresponding to the first position notifying luminescence member 280. A first bearing 410 of the coupling unit 400 is mounted on an inner surface of the first cover member 310, which faces the illuminator winding bobbin 210, to enable the illuminator winding bobbin 210 to be rotatably coupled to the first cover member 310. At this point, the first bearing 410 is mounted on the first cover member 310 to enable a central axis to be located at a position corresponding to the first fixing through hole 224 formed at the illuminator winding bobbin 210. Referring to FIGS. 1 and 2, the first cover member 310 is spaced apart from and coupled to the second cover member 320, which will be described below, through one side of a coupling bar 311 that is formed to extend to a predetermined distance and the cover member coupling bolt 330. A grip part 315 is formed to extend in a direction of the second cover member 320 spaced apart from the first cover member 310 at an upper part thereof and enable a user to grip the grip part 315. Also, a portion of a lower end of the first cover member 310, which corresponds to the bobbin unit 200, is formed to extend in the direction of the second cover member 320.

The second cover member 320 is coupled to the other end of the coupling bar 311 in a plate shape that is formed to correspond to the first cover member 310, and the luminescence indicator 340 is formed at a position corresponding to the second position notifying luminescence member 290. Also, the second cover member 320 is coupled to a rotation inducing member 460 to enable the power supply bobbin 250 coupled to the illuminator winding bobbin 210 to be rotated.

The second cover member 320 accommodates the rotation inducing member 460 that is fixedly mounted on the manipulator mounting part 275, and is provided with a rotation guide depression 325 configured to guide the rotation inducing member 460 to be moved in a circumferential direction. The rotation guide depression 325 is formed along a circumferential direction of the manipulator mounting part 275. It may be preferable to form the rotation guide depression 325 to correspond to a diameter that is formed by a plurality of rotation inducing members 460, each of which is spaced apart from one another in the circumferential direction.

An opening 323 is formed to pass through at the second cover member 320 to open the power supplier 273 and the manipulator 276, which are mounted on the second cover member coupler 270, thereby facilitating user operation of the power supplier 273 and the manipulator 276. Referring to FIGS. 1 and 2, the opening 323 is formed to be located at an inner side, of the second cover member 320, more than the luminescence indicator 340.

A plurality of coupling bars 311 are mounted, spaced apart from one another at a regular interval, along the edge of each of the first and second cover members 310 and 320, to enable the bobbin unit 200 to be located at an inner side of the plurality of coupling bars 311. A guide part 317 configured to guide forward and backward movement of the linear illuminator 100 is formed at one side of the case 300 by arranging and mounting the plurality of coupling bars 311 on the first and second cover members 310 and 320 to enable the linear illuminator 100 to be moved out.

The luminescence indicators 340 are respectively formed at positions corresponding to the first and second position notifying luminescence members 280 and 290 mounted on the bobbin unit 200 to enable verification of luminescence state of the first and second position notifying luminescence members 280 and 290 from the outside. The luminescence indicators 340 are provided with a plurality of luminescence verifying through holes 341, each of which is formed by passing through from the outer circumferential surface of each of the first and second cover members 310 and 320 to an inner circumferential surface of each thereof. The plurality of luminescence verifying through holes 341 are respectively formed to pass through in a long hole along an extending direction of each of the first and second position notifying luminescence members 280 and 290, and spaced apart from one another at a predetermined interval along the extending direction.

The shape and a mounting position of the grip part 315 are not limited to FIGS. 1 and 2 as long as the evacuation guidance device 1 for rescue can be gripped or carried. Also, a shoulder strap (not shown) for sling on his or her shoulder may be applied to the evacuation guidance device 1 capable of performing bidirectional communication.

The case 300 according to one embodiment of the present disclosure is configured with a structure having one side at which the linear illuminator 100 is moved out and the other side open, and alternatively, it may be formed to open only one side or only the guide part 317.

The coupling unit 400 is configured with the first bearing 410 coupled to the first cover member 310, the fixing member 420 configured to pass through the first fixing through hole 224 of the illuminator winding bobbin 210 and the second fixing through hole 263 of the winding unit accommodation part 261 and including one side fixedly installed at the first bearing 410, a first escape preventing ring 430 located between the first cover member coupler 223 and the fixing member coupler 262 and through which the fixing member 420 passes, a second escape preventing ring 440 configured to come into contact with a surface facing the power supplier mounting part 271 of the fixing member coupler 262 and through which the fixing member 420 passes, and a safety pin 450 configured to pass through the fixing member 420 in a direction perpendicular to a length direction of the fixing member 420 at the end of the other side thereof to prevent the second escape preventing ring 440 from escaping.

The fixing member 420 is formed as a square column, and the first fixing through hole 224 and the second fixing through hole 263 are formed to pass through, corresponding to the cross-section shape of the fixing member 420. Therefore, when the illuminator winding bobbin 210 and the power supply bobbin 250 are rotated in one direction, the fixing member 420 is also rotated in the one direction and serves to support the illuminator winding bobbin 210 and the power supply bobbin 250 to maintain the same rotation angle of each of the illuminator winding bobbin 210 and the power supply bobbin 250. The first escape preventing ring 430 serves to prevent the illuminator winding bobbin 210 from escaping from the fixing member 420 and eliminate a gap between the illuminator winding bobbin 210 and the power supply bobbin 250 to assist in stable rotation movement. The second escape preventing ring 440 prevents the illuminator winding bobbin coupler 260 from escaping from the fixing member 420, and the second escape preventing ring 440 is prevented from escaping by the safety pin 450. The safety pin 450 may be preferably made of metal, aluminum, copper, and the like to be bendable and not to be restored without an external force.

The communication unit enables bidirectional communication between the end of one side of the linear illuminator 100, which is unwound from the bobbin unit 200, and the bobbin unit 200, and is configured with a communication terminal 510, a second operating button 277, and the controller 530.

The communication terminal 510 is installed at the end of one side of the linear illuminator 100 unwound from the bobbin unit 200.

The communication terminal 510 is formed to be gripped, one side of the communication terminal 510 is connected to the end of one side of the linear illuminator 100, and the other side thereof includes a terminal main body 511 at which a ring part 111 is formed and a first operating button 513 mounted on the terminal main body 511 and configured to generate a first electrical signal by a manipulation of a field command post located at the safety zone or a commander.

The second operating button 277 is connected to the end of the other side of the linear illuminator 100 through the controller 530 and the inverter 600 as the manipulator 276, is electrically connected to the communication terminal 510, and generates a second electrical signal according to a manipulation of a user.

The controller 530 is installed at the power supply bobbin 250, is connected to the second operating button 277 and the end of the other side of the linear illuminator 100, controls supplying of power to the communication terminal 510 through the linear illuminator 100 according to an operating state of each of the first operating button 513 and the second operating button 277, and receives the first electrical signal or controls transmission of the second electrical signal to the communication terminal 510.

Also, the controller 530 is connected to the battery 273 and the inverter 600 to control power applied from the battery 273 and supplies the power to the linear illuminator 100 and the first and second position notifying luminescence member 280 and 290 through the inverter 600.

Here, operation of the evacuation guidance device 1 for rescue according to one embodiment of the present disclosure, which has a configuration as described above, will be described.

When a rescue agent enters a danger zone, the evacuation guidance device 1 for rescue may secure an escape route for evacuees in advance for the evacuees to escape from the danger zone to a safety zone, when an emergency calamity occurs.

The rescue agent entering the danger zone from the safety zone grips or carries the evacuation guidance device 1 and manipulates the second operating button 277 to emit light from the linear illuminator 100 and the first and second position notifying luminescence members 280 and 290. A luminescence state of each of the first and second position notifying luminescence members 280 and 290 may be verified through the luminescence verifying through holes 341 of the luminescence indicators 340.

In a state in which the battery 273 is mounted on the power supplier mounting part 271, the rescue agent or a user manipulates the second operating button 277 to supply power required for operating the inverter 600 and emitting light from the linear illuminator 100 and the first and second position notifying luminescence members 280 and 290 through the controller 530. The inverter 600 serves to receive a direct current (DC) power applied from the battery 273 through the controller 530 and convert the DC power into AC power suitable for the linear illuminator 100. The power converted into AC through the inverter 600 is supplied to the first and second position notifying luminescence members 280 and 290 and the linear illuminator 100.

Further, after the ring part 111 installed at the end of the communication terminal 510 is hooked and fixed at a portion of a surrounding structure in the safety zone, the linear illuminator 100 is unwound from the illuminator winding bobbin 210 as the rescue agent enters the danger zone, and the handle 279 is rotated in a circumferential direction to move the linear illuminator 100 out through the guide part 317.

When the handle 279 is rotated in a clockwise direction based on the outer circumferential surface of the second cover member 320 to unwind the linear illuminator 100 from the bobbin unit 200, the rotation inducing member 460 is rotated in a circumferential direction along the rotation guide depression 325, and the power supply bobbin 250, on which the handle 279 is mounted, is rotated in the clockwise direction. As the illuminator winding bobbin 210, which is coupled to the power supply bobbin 250 through the fixing member 420, is rotated in the clockwise direction, the same as the rotational direction of the power supply bobbin 250, the linear illuminator 100 is unwound.

The escape route may be secured by the linear illuminator 100 that is unwound according to an entering route of the rescue agent, and, even when field of view is narrowed with fire or other dust, the escape route may be discriminated by luminescence of the linear illuminator 100. Also, the evacuee may easily determine a position of the rescue agent by luminescence of the first and second position notifying luminescence members 280 and 290, so that there is an advantage in which the evacuee may efficiently receive guidance of the rescue agent. Further, when returning to the safety zone, the rescue agent rotates the handle 279 in a counterclockwise direction based on the outer circumferential surface of the second cover member 320 to wind the linear illuminator 100 on the bobbin unit 200.

Further, the evacuation guidance device 1 for rescue according to a first embodiment of the present disclosure may transmit the first and second electrical signals to the communication terminal 510 installed at the end of one side of the linear illuminator 100 and the second operating button 277 installed at the bobbin unit 200 through the linear illuminator 100.

For example, when the first or second operating button 513 or 277 is pressed over a predetermined time, power of the communication terminal 510 and the power supply bobbin 250 may be turned on or turned off from an ON state.

Luminescence state of the linear illuminator 100 may be controlled through the controller 530 according to a pressed state or the number of times each of the first operating button 513 and the second operating button 277 is pressed. That is, according to a manipulation of each of the first and second operating buttons 513 and 277, the controller 530 may set the linear illuminator 100 to a first luminescence state in which the linear illuminator 100 continuously emits light, to a second luminescence state in which the linear illuminator 100 emits light for a long period and then flickers, to a third luminescence state in which the linear illuminator 100 emits light for a short period and then flickers, and to a fourth luminescence state in which the linear illuminator 100 alternatingly emits light for the long and short periods.

According to a signal agreed between the rescue agent and the field command post, when the second operating button 277 is pressed one more time for a short period while in an ON state of the power supply bobbin 250 in which the linear illuminator 100 emits light, the evacuation guidance device 1 for rescue may control the linear illuminator 100 to emit light in the fourth luminescence state, thereby indicating a state in which a rescue is currently normally being performed. Also, when the second operating button 277 is pressed two more times, the evacuation guidance device 1 for rescue, which is capable of performing bidirectional communication, may control the linear illuminator 100 to emit light in the third luminescence state, thereby transmitting a current emergency rescue request, an alarm state, or the like to the field command post or the commander.

That is, the evacuation guidance device 1 for rescue may transmit a threat situation of the rescue agent or the evacuee to the field command post or the commander at the outside and may achieve the purpose of effectively integrating the power of all rescue agents, the commander, and units in an on-site command procedure.

The evacuation guidance device 1 for rescue according to a first embodiment of the present disclosure may enable a position of the bobbin unit 200 to be identified through the first and second position notifying luminescence members 280 and 290, so that there is an advantage in which a position of the evacuee or the rescue agent may be easily determined.

Also, the evacuation guidance device 1 for rescue according to the present disclosure is provided with a communication line that is configured with the communication terminal 510, the linear illuminator 100, and the second operating button 277, and thus a simple communication between the rescue agent and the commander is possible, so that there is an advantage in which a rescue situation may be easily determined.

Figure 6:
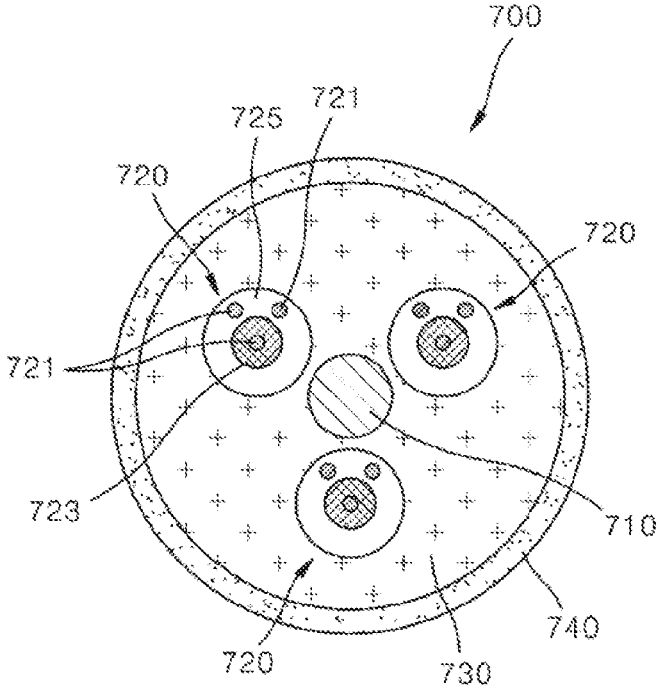
FIG. 6 is a cross-sectional view of a linear illuminator according to a second embodiment of the present disclosure.

Meanwhile, a cross-sectional view of a linear illuminator 700 of an evacuation guidance device for rescue according to a second embodiment of the present disclosure is shown in FIG. 6. The same reference numeral is given to a component having the same function shown in the above described drawings.

As shown in FIG. 6, the linear illuminator 700 may be configured with a plurality of EL wires.

The linear illuminator 700 is configured with a linear central strength member 710 formed to extend to wind and unwind according to a rotational direction of the illuminator winding bobbin 210, which will be described below, and located at a central line, a luminescence part 720 configured to extend along a length direction of the central strength member 710 and provided at an outer side thereof, and sheath parts 730 and 740 configured to cover an outer side of each of the central strength member 710 and the luminescence part 720.

The central strength member 710 may be configured with any one of a two-fold yarn and a high carbon steel wire which are conductive and capable of increasing tensile strength.

As shown in FIG. 6, the luminescence part 720 is configured with an EL wire 721 configured to extend along the length direction of the central strength member 710, a fluorescent material 723 configured to surround an outer side of the EL wire 721, and a Teflon sheath layer 725 configured to surround the outer side of the fluorescent material 723.

As shown in FIG. 6, an EL wire may be additionally applied inside the sheath layer 725.

The central strength member 710 of the linear illuminator 700 acts as a minus electrode and the EL wire 721 acts as a plus electrode, and thus they are used in communication between the communication terminal 510 and the second operating button 277.

The sheath parts 730 and 740 are configured with a first sheath layer 730 for surrounding the central strength member 710 and the luminescence part 720, and a second sheath layer 740 for surrounding the first sheath layer 730.

The EL wire 721 may have a structure of the EL wire according to the first embodiment of the present disclosure, and, although not shown in the drawing, it may have a structure formed with a core wire located at a central portion, a fluorescent material configured to surround the core wire, and a coating layer configured to surround the fluorescent material and including a radial wire. At this point, although not shown in the drawing, the sheath parts 730 and 740 may further include a color filter configured to convert light emitted from the EL wire 721 into a predetermined color. The color filter may be set to one color among various colors including yellow, green, red, blue, and the like. Also, any one layer of the first and second sheath layers 730 and 740 may be substituted with a color filter to be applied to the sheath parts 730 and 740.

A controller 530 according to the second embodiment of the present disclosure controls supplying of power to the bobbin unit 200 according to an operation state of the second operating button 277 and controls power required for a luminescence state of the linear illuminator 700 according to first and second electrical signals through an electrical path via the luminescence part 720 and the central strength member 710.

The evacuation guidance device for rescue according to the second embodiment of the present disclosure is provided with a plurality of EL wires, so that there is an advantage in which verification of luminescence of the linear illuminator 700 is easily determined even when an escape route is long.

Figure 7:
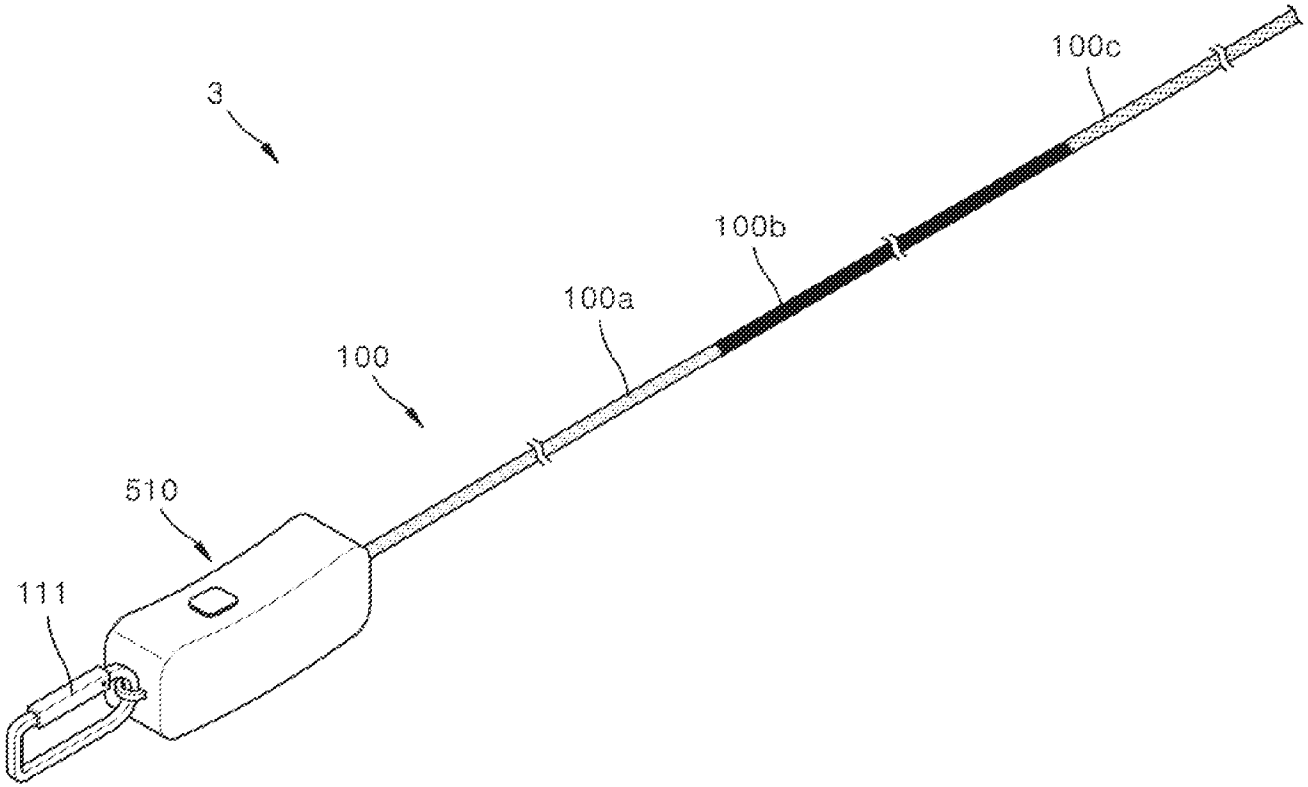
FIG. 7 is a perspective view illustrating a part of a linear illuminator of an evacuation guidance device for rescue according to a third embodiment of the present disclosure.

Meanwhile, a perspective view of a part of linear illuminator 100 of an evacuation guidance device 3 for rescue according to a third embodiment of the present disclosure is shown in FIG. 7.

A color filter 150 according to the third embodiment of the present disclosure is configured to change color at a regular interval for determining length of the linear illuminator 100 that is unwound from the bobbin unit 200. That is, the color filter 150 is configured with a different color at a regular interval.

Referring to FIG. 7, an example in which a filter color of the color filter 150 is configured with colors in the order of blue, red, and orange at an interval of 10 meters will be described. Light emitted from a luminescence layer 130 passes through the color filter 150 to be converted into a blue color light 100*a*, a red color light 100*b*, and an orange color light 100*c* at an interval of 10 meters. The color filter 150 may be configured with different colors for changing color of light at an interval of 5 meters or 3 meters. However, a change interval of filter color of the color filter 150 is not limited to the above described example, and it should be noted that various filter colors may be set. Also, it should be noted that length of the linear illuminator 100 is not limited.

In the evacuation guidance device 3 for rescue according to the third embodiment of the present disclosure, the linear illuminator 100, which is unwound from the illuminator winding bobbin 210 and moved out from the case 300, emits a different color of light at a regular interval according to a filter color of the color filter 150, so that there is an advantage in which the evacuee or the rescue agent may determine length of the linear illuminator 100 that is unwound. Therefore, the rescue agent or the evacuee may approximately recognize a distance from the danger zone to the safety zone through a color of light, which is changed at a regular interval, emitted from the linear illuminator 100 so that it may possible to prevent a safety accident and reduce a psychological burden.

Although not shown in the drawing, it should be noted that a color filter having a different color at a regular interval may be applied to a structure of the linear illuminator according to the second embodiment of the present disclosure.

Figure 8:
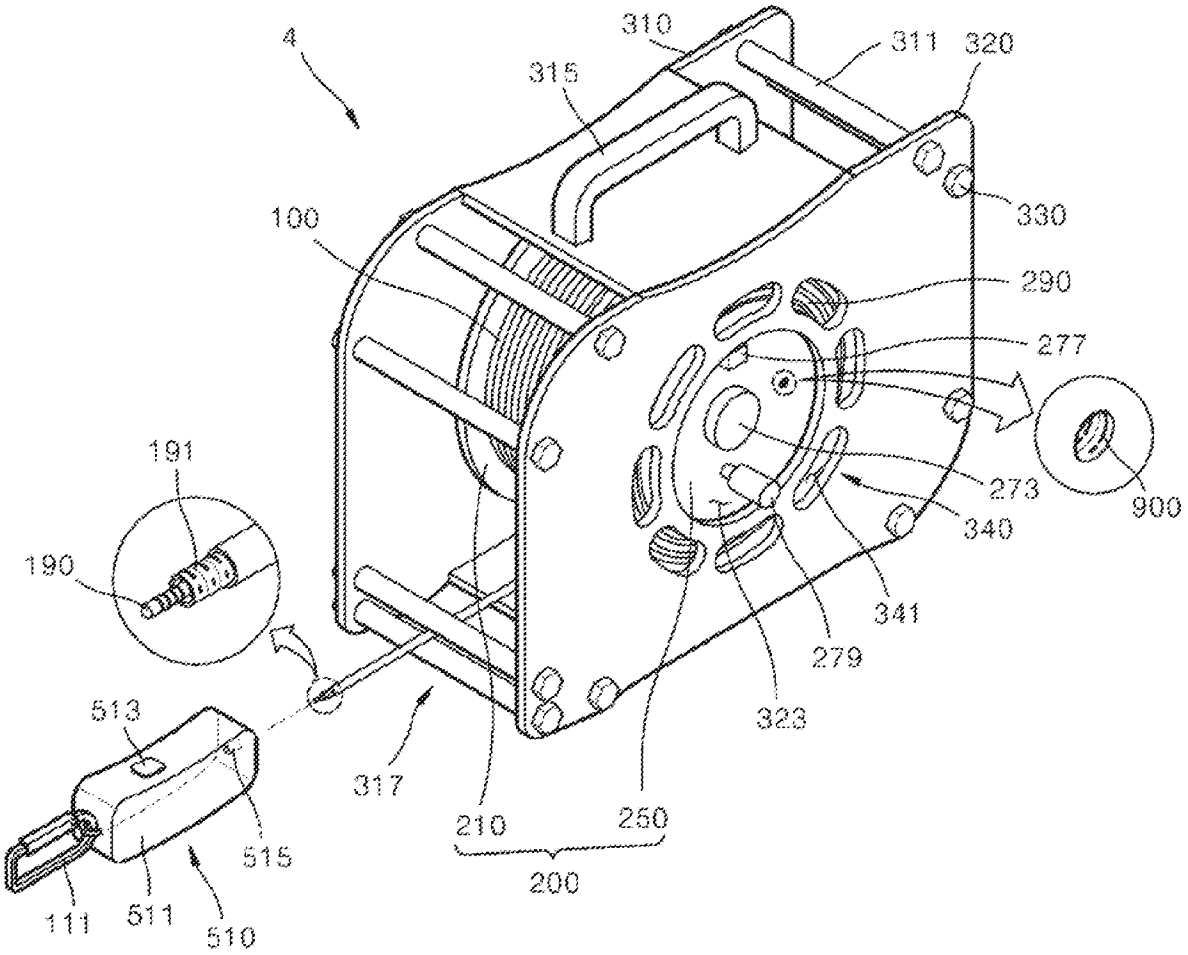
FIG. 8 is a partially exploded perspective view of an evacuation guidance device for rescue according to a fourth embodiment of the present disclosure.
Figure 9:
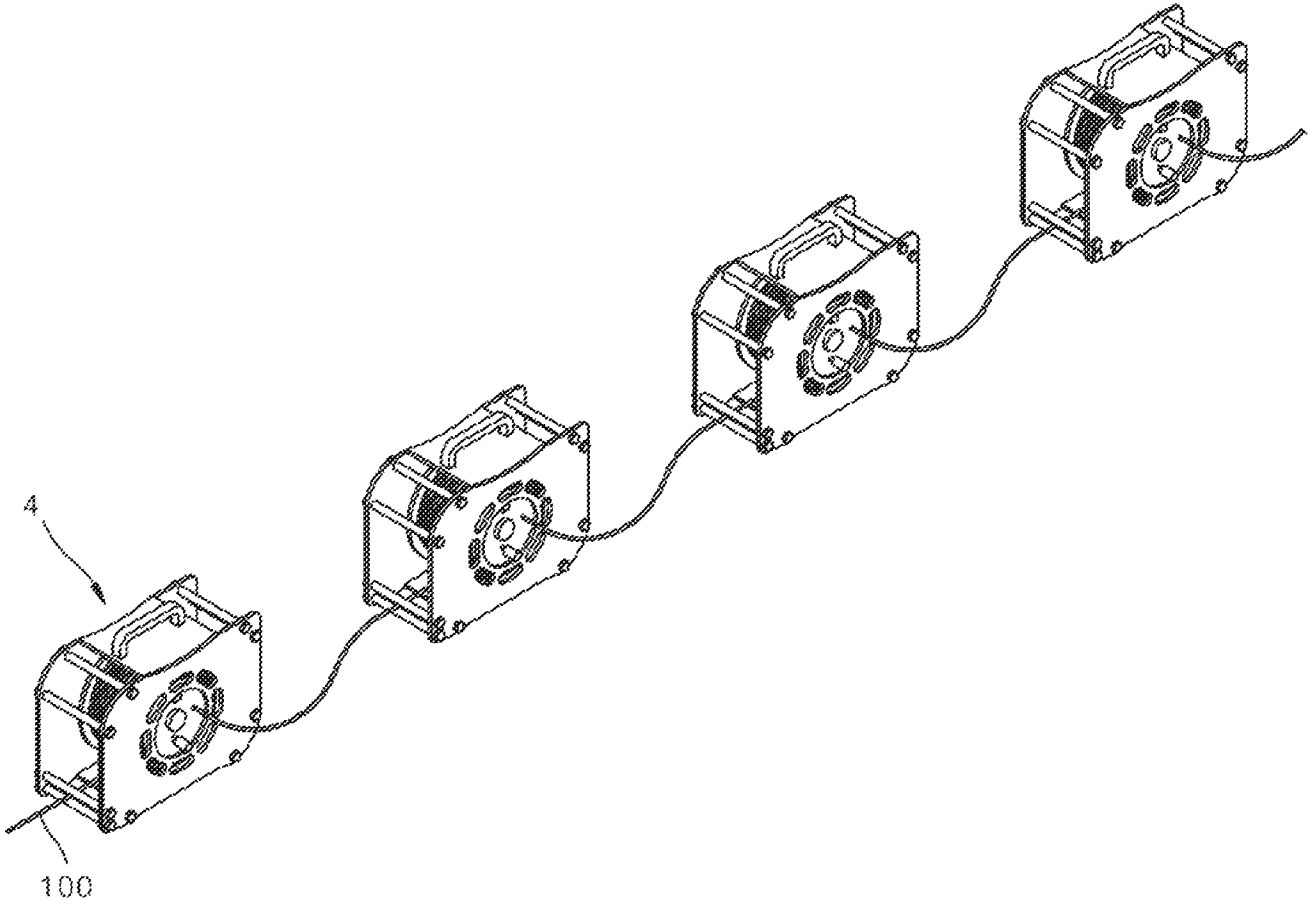
FIG. 9 is a perspective view illustrating a state in which the evacuation guidance devices for rescue of FIG. 8 are connected in series.

Meanwhile, an evacuation guidance device 4 for rescue according to a fourth embodiment of the present disclosure is shown in FIGS. 8 and 9. The same reference numeral is given to a component having the same function shown in the above described drawings.

A linear illuminator 800 of the evacuation guidance device 4 for rescue according to the fourth embodiment of the present disclosure is provided with a terminal part 190 capable of being detached from the communication terminal 510 and electrically connecting thereto in the structure of each of the linear illuminators 100 and 700 according to the first and third embodiments of the present disclosure.

A male screw 191 and a female screw 515, which are screw coupled to each other, are respectively formed at the end of one side at which the terminal part 190 of the linear illuminator 800 is formed and an end side of the communication terminal 510 into which the terminal part 190 is inserted.

Further, the power supply bobbin 250 according to the fourth embodiment of the present disclosure is provided with a serial connector 900 configured to accommodate the terminal part 190 separated from a communication terminal 510 and electrically connect to the terminal part 190.

Therefore, the terminal part 190 of the evacuation guidance device 4 for rescue according to the fourth embodiment of the present disclosure may be connected to a serial connector 900 of another evacuation guidance device 4 for rescue having a structure that is the same as that of the evacuation guidance device 4 for rescue, so that the terminal part 190 may be used for the purpose of connecting a plurality of evacuation guidance devices 4 for rescue in series as shown in FIG. 9.

Hereinbefore, as described above, in the evacuation guidance device for rescue according to the present disclosure, a position of the bobbin unit 200 may be identified through the first and second position notifying luminescence members 280 and 290, so that there is an advantage in which a position determination of the evacuee or the rescue agent, or of the safety zone where the evacuee or the rescue agent desires to move may be easy.

Also, the evacuation guidance device for rescue according to the present disclosure emits a different color of light at a regular interval through the color filter 150 of the linear illuminator 100, and thus the evacuee or the rescue agent escapes by recognizing a distance of the escape route, so that there is an advantage in which a frequency of a safety accident may be reduced.

Further, the evacuation guidance device for rescue according to the present disclosure is provided with a communication unit capable of transmitting intent using a luminescence state of a linear illuminator so that bidirectional communication between the rescue agent and the commander at the safety zone is possible.

While the present invention has been described with reference to exemplary embodiments thereof, it will be apparent to those skilled in the art that various modifications and equivalent other embodiments can be devised from the above-described exemplary embodiments of the present invention. Therefore, the true scope of the present invention should be determined by the technical spirit of the appended claims.

What is claimed is:

1. An evacuation guidance device for rescue, comprising:

a bendable linear illuminator;

a bobbin unit configured to wind and unwind the bendable linear illuminator according to a rotational direction, including first and second positions notifying luminescence members installed at an outer side of the bobbin unit and configured to emit light to enable position identification, and configured to supply power to the bendable linear illuminator and the first and second positions notifying luminescence members; and a case configured to rotatably accommodate the bobbin unit to enable the bendable linear illuminator to be wound and unwound according to a rotational direction of the bobbin unit and at which a luminescence indicator is formed to enable verification of a luminescence state of each of the first and second positions notifying luminescence members.

2. The evacuation guidance device for rescue of claim 1, wherein the bendable linear illuminator is provided with a color filter configured to change color of light emitted from a light source at a regular interval to enable identification of length of the bendable linear illuminator that is unwound from the bobbin unit.

3. The evacuation guidance device for rescue of claim 1, wherein the luminescence indicator is provided with a plurality of luminescence verifying through holes which are formed at positions corresponding to the first and second positions notifying luminescence members by passing through from an outer circumferential surface of the case to an inner circumferential surface thereof and are spaced apart from one another along an extending direction of each of the first and second positions notifying luminescence members.

4. The evacuation guidance device for rescue of claim 3, wherein the bobbin unit includes:

an illuminator winding bobbin configured to wind or unwind the bendable linear illuminator according to a rotational direction and including one side, which is adjacent to each of the luminescence verifying through holes formed at one side of the case, on which the first position notifying luminescence member is mounted; and a power supply bobbin mounted on the other side of the illuminator winding bobbin to be rotated by corresponding to a rotational direction and a rotational angle of the illuminator winding bobbin, including the second position notifying luminescence member mounted adjacent to each of the luminescence verifying through holes formed at the other side of the case, and configured to supply power to enable the bendable linear illuminator and the first and second position notifying luminescence members to emit light.

5. The evacuation guidance device for rescue of claim 4, wherein the case includes:

a first cover member to which the illuminator winding bobbin is rotatably coupled and having each of the luminescence verifying through holes, each of which is formed at a position corresponding to the first position notifying luminescence member; and a second cover member coupled to the first cover member, rotatably coupled to the power supply bobbin that is coupled to the illuminator winding bobbin, and having the luminescence verifying through holes, each of which is formed at a position corresponding to the second position notifying luminescence member.

6. The evacuation guidance device for rescue of claim 5, wherein the illuminator winding bobbin includes:

a winding unit formed to extend and enable the bendable linear illuminator to be wound along an outer circumferential surface, configured to provide a first inner space that is open in a direction of the second cover member, and including one side rotatably coupled to the first cover member and the other side coupled to the power supply bobbin;

a first flange formed to have an outer diameter greater than that of the winding unit at one end thereof adjacent to the first cover member, and including a surface facing the first cover member, at which the first position notifying luminescence member is installed; and a second flange formed to extend and have an outer diameter greater than that of the winding unit at the other end thereof.

7. The evacuation guidance device for rescue of claim 6, wherein the power supply bobbin includes:

an illuminator winding bobbin coupler including a winding unit accommodation part which is formed to be partially accommodated in the first inner space and includes one end fixedly coupled to the illuminator winding bobbin, and an inverter mounting part having an outer diameter larger than that of the winding unit accommodation part at the other end thereof, formed to extend in a direction of the second cover member, and including a second inner space formed inside the inverter mounting part to be open in the direction of the second cover member, thereby enabling an inverter, which is connected to the bendable linear illuminator and the first and second positions notifying luminescence member, to be mounted on the second inner space; and a second cover member coupler having one side fixedly coupled to the illuminator winding bobbin coupler and the other side rotatably coupled to the second cover member, configured to provide a power supplier supplying power to the inverter and a manipulation part connecting and disconnecting a supply of the power of the power supplier to the inverter to control the bendable linear illuminator and the first and second positions notifying luminescence members to emit light through the inverter and manipulating rotation of the illuminator winding bobbin, and including the second position notifying luminescence member installed at a surface facing the second cover member.

8. The evacuation guidance device for rescue of claim 7, wherein the second cover member is provided with an opening formed to pass through and enable the power supplier and the manipulation part to be open, thereby facilitating user manipulation of the power supplied and the manipulation part which are mounted on the second cover member coupler.

9. The evacuation guidance device for rescue of claim 1, further comprising:

a communication unit configured to enable bidirectional communication between the end of one side of the bendable linear illuminator, which is unwound from the bobbin unit, and the bobbin unit, wherein the evacuation guidance device for rescue is able to perform bidirectional communication.

10. The evacuation guidance device for rescue of claim 9, wherein the bendable linear illuminator includes:

a central strength member formed to extend and enable a winding and unwinding according to a rotational direction of the bobbin unit and located on a center line;

a luminescence part extending along a length direction of the central strength member and provided at an outer side thereof; and a sheath part configured to cover an outer side of each of the central strength member and the luminescence part, and the communication unit includes:

a communication terminal installed at the end of the one side of the bendable linear illuminator being unwound from the bobbin unit and including a first operating button configured to generate a first electrical signal;

a second operating button installed at the bobbin unit and configured to generate a second electrical signal; and a controller connected to each of the second operating button and the end of the other side of the bendable linear illuminator, configured to control a supply of power to the bobbin unit according to an operation state of the second operating button, and configured to control power required for the luminescence state of the bendable linear illuminator according to the first and second electrical signals through an electrical path via the luminescence part and the central strength member.

11. The evacuation guidance device for rescue of claim 10, wherein the central strength member is formed with any one of a two-fold yarn and a high carbon steel wire which are conductive and able to increase tensile strength.

12. The evacuation guidance device for rescue of claim 10, wherein the bendable linear illuminator is provided with a terminal part provided at the end of the one side of the bendable linear illuminator and configured to be detachable from the communication terminal and electrically connect thereto.

13. The evacuation guidance device for rescue of claim 12, wherein the bobbin unit is provided with a serial connector configured to accommodate the terminal part separated from the communication terminal and electrically connected to the terminal part.

* * * * *